US011747023B2

(12) United States Patent
Armstrong et al.

(10) Patent No.: US 11,747,023 B2
(45) Date of Patent: Sep. 5, 2023

(54) ADAPTABLE PORT FOR AN OVEN APPLIANCE

(71) Applicant: Haier US Appliance Solutions, Inc., Wilmington, DE (US)

(72) Inventors: James Lee Armstrong, Louisville, KY (US); Omar Santana, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 2 days.

(21) Appl. No.: 17/019,539

(22) Filed: Sep. 14, 2020

(65) Prior Publication Data

US 2022/0082265 A1 Mar. 17, 2022

(51) Int. Cl.
*F24C 7/08* (2006.01)
*F24C 3/12* (2006.01)

(52) U.S. Cl.
CPC ..... *F24C 7/085* (2013.01); *F24C 3/128* (2013.01)

(58) Field of Classification Search
CPC .. G01K 7/16; G01K 7/18; G01K 1/00; G01K 1/16
USPC ..... 219/486, 681, 709, 713
See application file for complete search history.

(56) References Cited

U.S. PATENT DOCUMENTS

| | | | | |
|---|---|---|---|---|
| 2,657,580 | A * | 11/1953 | Schroeder | G01K 13/10 99/421 TP |
| 4,186,368 | A * | 1/1980 | White | G01K 7/183 374/185 |
| 5,859,522 | A * | 1/1999 | Theobald | H04M 1/6041 320/106 |
| 10,521,372 | B2 | 12/2019 | Kim | |
| 10,524,614 | B2 | 1/2020 | Gregory | |
| 2016/0026768 | A1* | 1/2016 | Singh | G01K 1/20 705/3 |

FOREIGN PATENT DOCUMENTS

| | | | | |
|---|---|---|---|---|
| EP | 2639511 | A2 * | 9/2013 | F24C 7/085 |
| EP | 2639511 | A2 | 9/2013 | |
| WO | WO-2015011355 | A1 * | 1/2015 | B60L 53/16 |

* cited by examiner

*Primary Examiner* — Thien S Tran
(74) *Attorney, Agent, or Firm* — Dority & Manning, P.A.

(57) ABSTRACT

An oven appliance assembly includes an oven appliance having a cabinet defining an oven cavity, a heat source disposed within the oven cavity, and a port having a socket. The oven appliance assembly also includes at least one oven accessory comprising a probe, a plug, and at least one resistive element. The plug includes a unique configuration for engagement with the socket of the port. The oven appliance assembly also includes a controller communicatively coupled with the oven appliance and the oven accessory. As such, the controller has at least one processor for performing a plurality of operations, including but not limited to determining a type of the oven accessory engaged with the port of the oven appliance based on a resistance value of the at least one resistive element of the oven accessory.

17 Claims, 6 Drawing Sheets

| OVEN ACCESSORY | RESISTANCE ID (Ohms) |
|---|---|
| MEAT PROBE | 1000 |
| PIZZA STONE PROBE | 2000 |
| CAKE DISH PROBE | 3000 |
| CASSEROLE DISH PROBE | 4000 |
| COFFEE ROASTER PROBE | 5000 |

ADAPTABLE PORT FOR AN OVEN APPLIANCE

FIELD OF THE INVENTION

The present subject matter relates generally to cooking appliances, and more particularly to an oven appliance having an adaptable port capable of detecting a type of oven accessory plugged therein.

BACKGROUND OF THE INVENTION

Conventional residential and commercial oven appliances generally include a cabinet that defines a cooking chamber for receipt of food items for cooking. Heating elements are positioned within the cooking chamber to provide heat to food items located therein. The heating elements can include, for example, radiant heating elements, such as a bake heating assembly positioned at a bottom of the cooking chamber and/or a broil heating assembly positioned at a top of the cooking chamber.

When cooking certain food items, it may be important to check or monitor the temperature within the cooking chamber, as well as the temperature of the food item, e.g., in order to ensure the food item is adequately cooked. As such, certain oven appliances include a temperature sensor for sensing the temperature within the cooking chamber. For example, the temperature sensor can be a resistance temperature detector (RTD), thermistor, or thermocouple located within a conductive sheath that extends into the cooking chamber. The temperature sensor is typically electrically insulated from the temperature sensor housing. Moreover, certain oven appliances include a probe assembly that generally includes a temperature probe configured for insertion into a food item for sensing the temperature of the food item, a wire or antenna that sends signals to and receives signals from the temperature probe, and a controller in communication with the wire/antenna to interpret the signals such that the temperature of the food item may be displayed or communicated to a user.

While such probe assemblies may accurately detect and display the temperature of food items within the cooking chamber, such probe assemblies present various challenges. For example, conventional ovens only have a single plug for the probe. Thus, the plug can be used for, at most, two accessories by detecting the ambient resistance thereof.

Accordingly, an oven appliance having an improved port that addresses one or more of the aforementioned challenges would be useful.

BRIEF DESCRIPTION OF THE INVENTION

Aspects and advantages of the invention will be set forth in part in the following description, or may be obvious from the description, or may be learned through practice of the invention.

In one aspect, the present disclosure is directed to an oven appliance assembly. The oven appliance assembly includes an oven appliance having a cabinet defining an oven cavity, a heat source disposed within the oven cavity, and a port having a socket. The oven appliance assembly also includes at least one oven accessory comprising a probe, a plug, and at least one resistive element. The plug includes a unique configuration for engagement with the socket of the port. The oven appliance assembly also includes a controller communicatively coupled with the oven appliance and the oven accessory. As such, the controller has at least one processor for performing a plurality of operations, including but not limited to determining a type of the oven accessory engaged with the port of the oven appliance based on a resistance value of the at least one resistive element of the oven accessory.

In another aspect, the present disclosure is directed to a method for operating an oven appliance having a port defining a socket. The method includes inserting a plug of an oven accessory into the socket. Further, the oven accessory has a probe, the plug, and at least one resistive element. The plug has a unique configuration. As such, the method also includes determining, via a controller of the oven appliance, a resistance value of the resistive element(s) of the oven accessory. Further, the method includes identifying, via the controller, a type of the oven accessory based on the resistance value of the resistive element(s) of the oven accessory. Moreover, the method includes selecting a cooking cycle for the oven appliance based on the type of oven accessory.

In yet another aspect, the present disclosure is directed to an oven appliance assembly. The oven appliance assembly includes an oven appliance having a cabinet defining an oven cavity, a heat source disposed within the oven cavity, and a port having a socket. The oven appliance assembly further includes a plurality of oven accessories compatible with the oven appliance. Each of the plurality of oven accessories includes a probe, a plug having a unique configuration for engagement with the socket of the port, and at least one resistive element. The oven appliance assembly further includes a controller communicatively coupled with the oven appliance for determining a type of each of the plurality of oven accessories when a respective plug is engaged with the port based on a resistance value of each of the resistive element(s) of the plurality of oven accessories.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
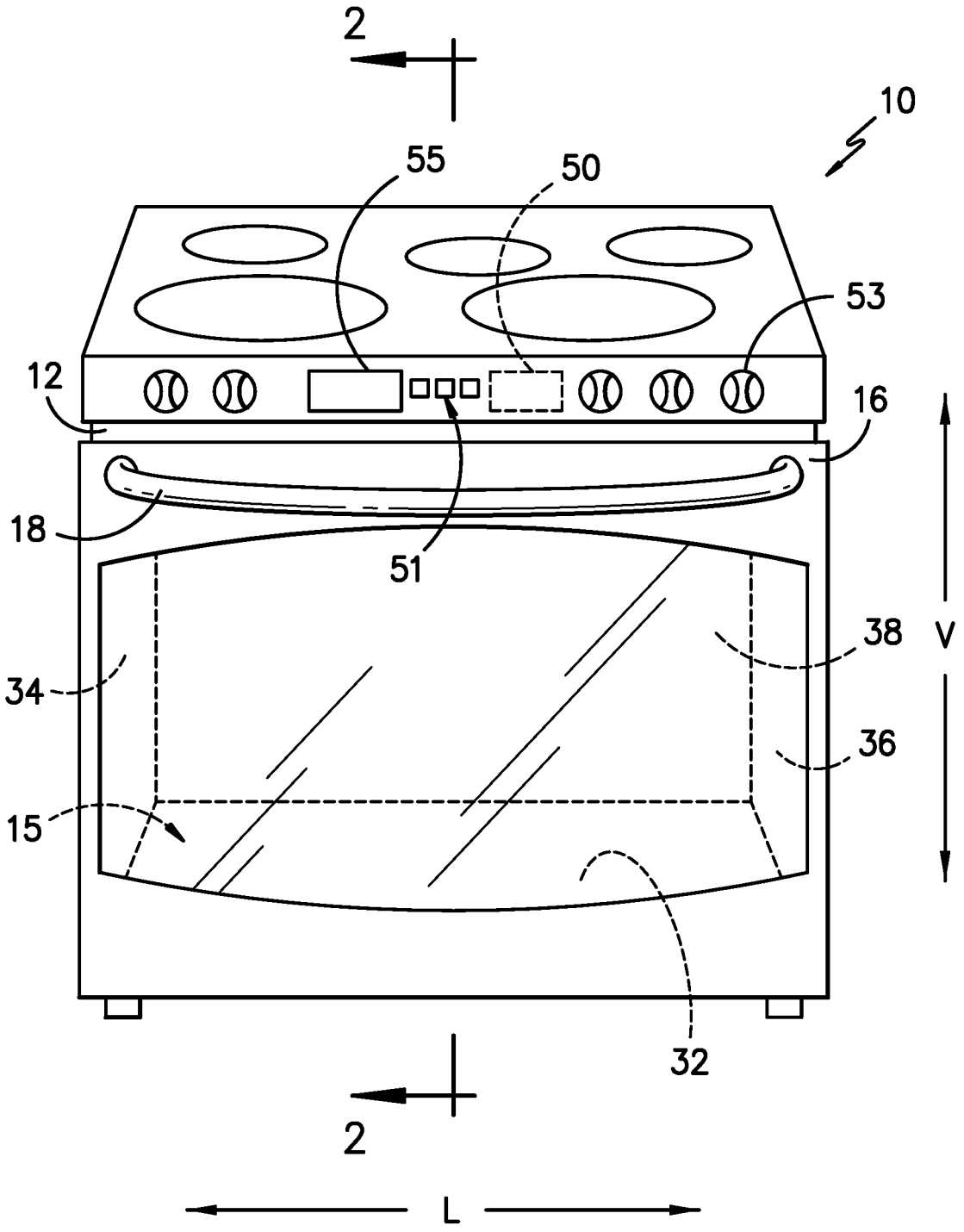
FIG. 1 illustrates a front perspective view of an oven appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
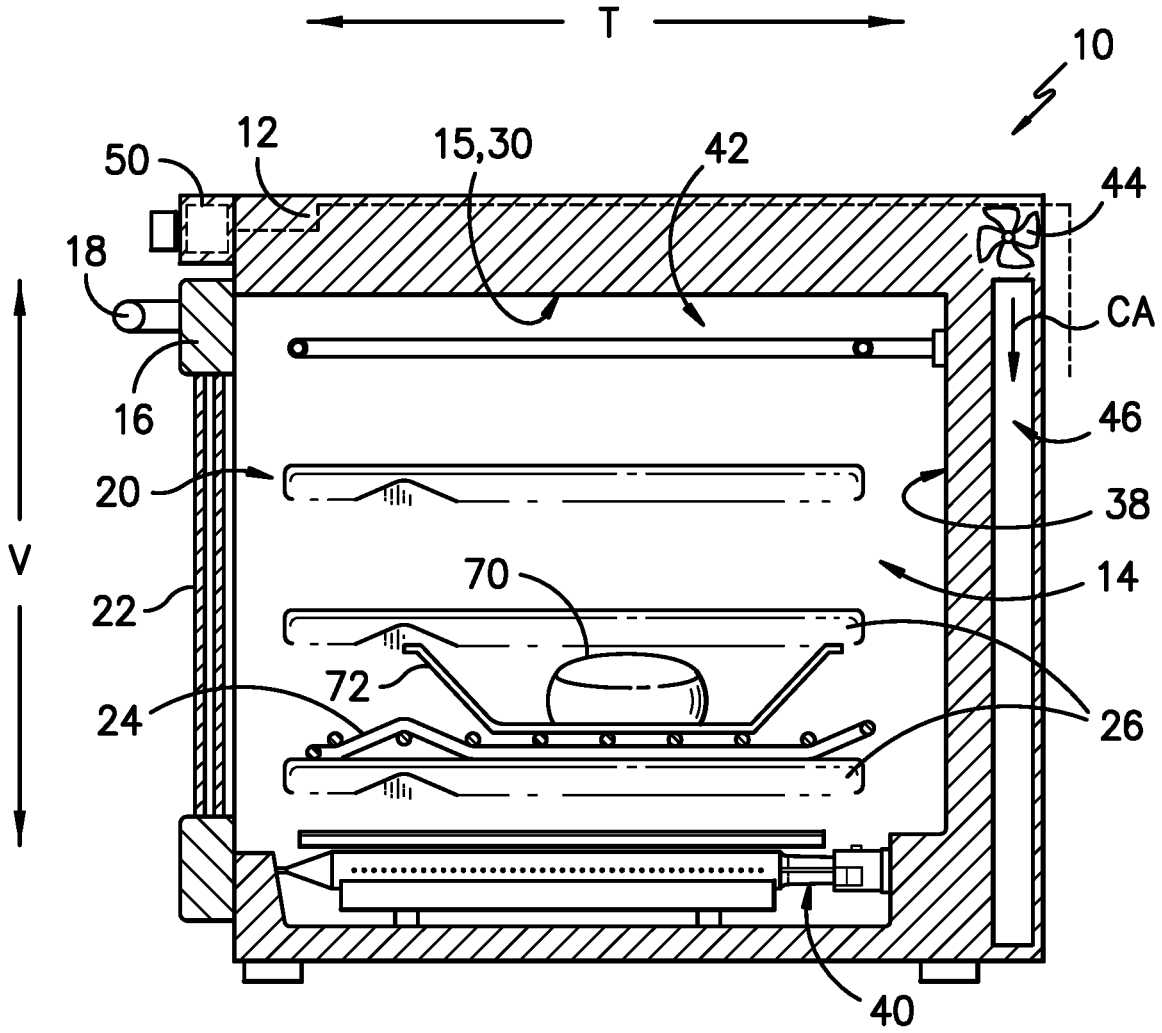
FIG. 2 illustrates a cross-sectional view of the example oven appliance of FIG. 1 taken along the line 2-2 of FIG. 1, wherein a temperature sensor is in a cavity-enclosed state.

Referring now to the figures, FIG. 1 illustrates a front perspective view of an exemplary oven appliance 10. FIG. 2 provides a cross-sectional view of oven appliance 10 taken along the line 2-2 of FIG. 1. As shown, the oven appliance 10 defines a vertical direction V, a lateral direction L, and a transverse direction T. The vertical direction V, lateral direction L, and transverse direction T are mutually perpendicular and form an orthogonal direction system. As will be understood, the oven appliance 10 is provided by way of example only, and the present subject matter may be used in any suitable oven appliance. Thus, the present subject matter may be used with other oven or range appliance configurations, e.g., that define multiple interior cavities for the receipt of food and/or having different configuration than what is shown in FIGS. 1 and 2.

Further, as shown, the oven appliance 10 includes an insulated cabinet 12 that defines an oven cavity, such as a cooking chamber 14. More particularly, the cooking chamber 14 is defined by various interior surfaces 15 of the cabinet 12. The cooking chamber 14 is configured for the receipt of one or more food items (e.g., food item 70) to be cooked. Moreover, as shown, the oven appliance 10 includes a door 16 rotatably mounted to the cabinet 12, e.g., with a hinge (not shown). A handle 18 is mounted to the door 16 and assists a user with opening and closing the door 16 in order to access the opening 20 to the cooking chamber 14. For example, a user can pull on the handle 18 to open or close the door 16 and access the cooking chamber 14 through the opening 20.

In addition, the oven appliance 10 can include one or more seals (not shown) between the door 16 and the cabinet 12 that assist with maintaining heat and cooking fumes within the cooking chamber 14 when the door 16 is closed as shown in FIG. 2. Multiple parallel glass panes 22 provide for viewing the contents of cooking chamber 14 when the door 16 is closed and assist with insulating the cooking chamber 14. A baking rack 24 may also be positioned in the cooking chamber 14 for receipt of one or more food items (e.g., food item 70) and/or utensils (e.g., utensil 72) containing food items. In such embodiments, the baking rack 24 may be slidably received onto embossed ribs 26 or sliding rails such that the rack 24 may be conveniently moved into and out of the cooking chamber 14 when the door 16 is open.

As shown, various sidewalls of the cabinet 12 define the cooking chamber 14. For this embodiment, the cooking chamber 14 includes a top wall 30 (FIG. 2) and a bottom wall 32 (FIG. 1) which are spaced apart along the vertical direction V. Further, as shown, a left sidewall 34 and a right sidewall 36 (as defined according to a front view as shown in FIG. 1) extend between the top wall 30 and the bottom wall 32, and are spaced apart along the lateral direction L. Moreover, a rear wall 38 extends between the top wall 30 and the bottom wall 32 as well as between the left sidewall 34 and the right sidewall 36, and is spaced apart from the door 16 along the transverse direction T. As such, the cooking chamber 14 is thus defined between the top wall 30, the bottom wall 32, the left sidewall 34, the right sidewall 36, and the rear wall 38.

In some embodiments, a gas fueled or electric bottom heating element 40 (e.g., a gas burner or an electric heating element) is positioned in cabinet 12, e.g., at a bottom portion of the cabinet 12. Accordingly, the bottom heating element 40 may be used to heat the cooking chamber 14 for both cooking and cleaning of oven appliance 10. The size and heat output of the bottom heating element 40 can be selected based on the e.g., the size of the oven appliance 10.

In yet other embodiments, a top heating element 42 may be positioned in the cooking chamber 14 of the cabinet 12, e.g., at a top portion of the cabinet 12. Thus, the top heating element 42 may be used to heat the cooking chamber 14 for both cooking/broiling and cleaning of the oven appliance 10. Like the bottom heating element 40, the size and heat output of top heating element 42 can be selected based on the e.g., the size of the oven appliance 10. In the example embodiment shown in FIG. 2, the top heating element 42 is shown as an electric resistance heating element. However, in alternative embodiments, a gas, microwave, halogen, or any other suitable heating element may be used instead of electric resistance heating element 42.

As further depicted in FIG. 2, the oven appliance 10 may further include a cooling fan 44 in fluid communication with a cooling passage 46 defined by rear wall 38 of cabinet 12. The cooling fan 44 is configured to urge a cooling airflow CA through cooling passage 46 to assist with cooling of the rear portion of oven appliance 10. Further, various electrical components may be positioned along the rear portion of the oven appliance 10 and may be cooled by the cooling airflow CA. In this way, the relatively hot temperatures within the cooking chamber 14 do not melt or otherwise render the electrical components inoperable.

In certain embodiments, the oven appliance 10 may also include a controller 50, e.g., configured to control one or more operations of the oven appliance 10. For example, the controller 50 may control at least one operation of the oven appliance 10 that includes one or more of heating elements 40 and 42. Further, the controller 50 may be in communication (via a suitable wired or wireless connection) with the heating element 40, the heating element 42, a user interface panel 51, a temperature sensing device, and other suitable components of the oven appliance 10, as discussed herein. In general, the controller 50 may be operable to configure the oven appliance 10 (and various components thereof) for cooking. Such configuration may be based, for instance, on a plurality of cooking factors of a selected operating cycle or mode, e.g., as selected at user interface panel 51.

Figure 3:
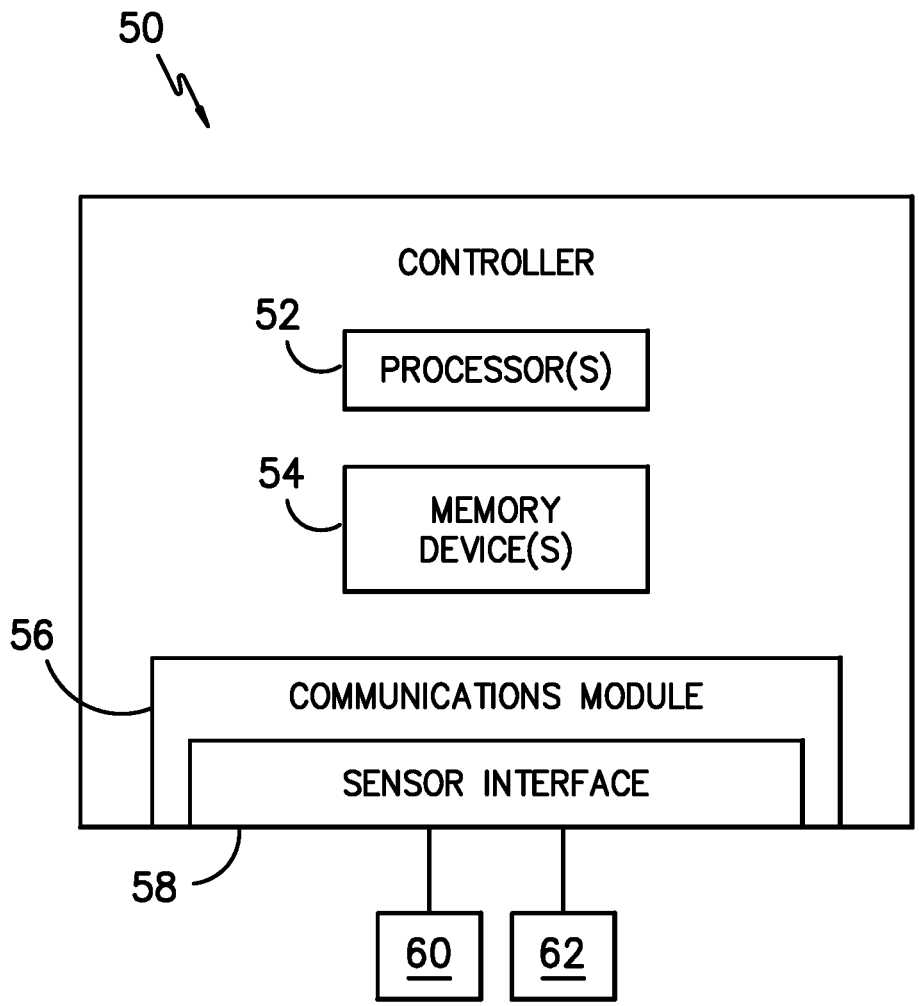
FIG. 3 illustrates a block diagram of one embodiment of a controller of an oven appliance according to the present disclosure.

By way of example, as shown in FIG. 3, there is illustrated a block diagram of one embodiment of various components of the controller 50 according to the present disclosure. As shown, the controller 50 may include one or more processor(s) 52 and associated memory device(s) 54 configured to perform a variety of computer-implemented functions (e.g., such as executing programming instructions or micro-control code associated with an operating cycle). The memory device(s) 54 (i.e., memory) may represent random access memory such as DRAM, or read only memory such as ROM or FLASH. In one embodiment, the processor(s) 52 executes programming instructions stored in the memory device(s) 54. The memory device(s) 54 may be a separate component from the processor(s) 52 or may be included onboard within the processor(s) 52. The memory device(s) 54 can store information accessible to processing device, including instructions that can be executed by processing device. Optionally, the instructions can be software or any set of instructions that, when executed by the processing device, cause the processing device to perform operations. For certain embodiments, the instructions include a software package configured to operate the oven appliance 10 and interpret one or more electrical signals. For example, the instructions may include a software package configured to execute commands based on feedback from a probe and antenna device as described more fully below.

Additionally, the controller 50 may also include a communications module 56 to facilitate communications between the controller 50 and the various components of the oven appliance 10. Further, the communications module 56 may include a sensor interface 58 (e.g., one or more analog-to-digital converters) to permit signals transmitted from the various components of the oven appliance 10, e.g. via one or more sensors 60, 62, to be converted into signals that can be understood and processed by the controller 50. It should be appreciated that the sensors may be communicatively coupled to the communications module 56 using any suitable means. For example, as shown, the sensors 60, 62 are coupled to the sensor interface 89 via a wired connection. However, in other embodiments, the sensors 60, 62 may be coupled to the sensor interface 58 via a wireless connection, such as by using any suitable wireless communications protocol known in the art.

As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 85 may generally comprise memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 85 may generally be configured to store suitable computer-readable instructions that, when implemented by the processor(s) 58, configure the controller 50 to perform various functions.

Furthermore, the controller 50 may be positioned in a variety of locations throughout the oven appliance 10. As illustrated, the controller 50 may be located within the user interface panel 51 of the oven appliance 10 as shown in FIGS. 1 through 2. In such embodiments, input/output ("I/O") signals may be routed between the controller 50 and various operational components of oven appliance 10, such as heating element 40, heating element 42, controls 53, display component 55, sensors, alarms, antennas, and/or other components as may be provided. For instance, signals may be directed along one or more wiring harnesses that may be routed through cabinet 12.

In some embodiments, the user interface panel 51 includes input components or controls 53, such as one or more of a variety of electrical, mechanical or electro-mechanical input devices. Controls 53 may include rotary dials, push buttons, and touch pads. Further, the controller 50 may be in communication with the user interface panel 51 and controls 53 through which a user may select various operational features and modes and monitor progress of the oven appliance 10. In additional or alternative embodiments, the user interface panel 51 may include a display component 55, such as a digital or analog display in communication with controller 50 and configured to provide operational feedback to a user. In certain embodiments, user interface panel 51 represents a general purpose I/O ("GPIO") device or functional block.

Figure 4:
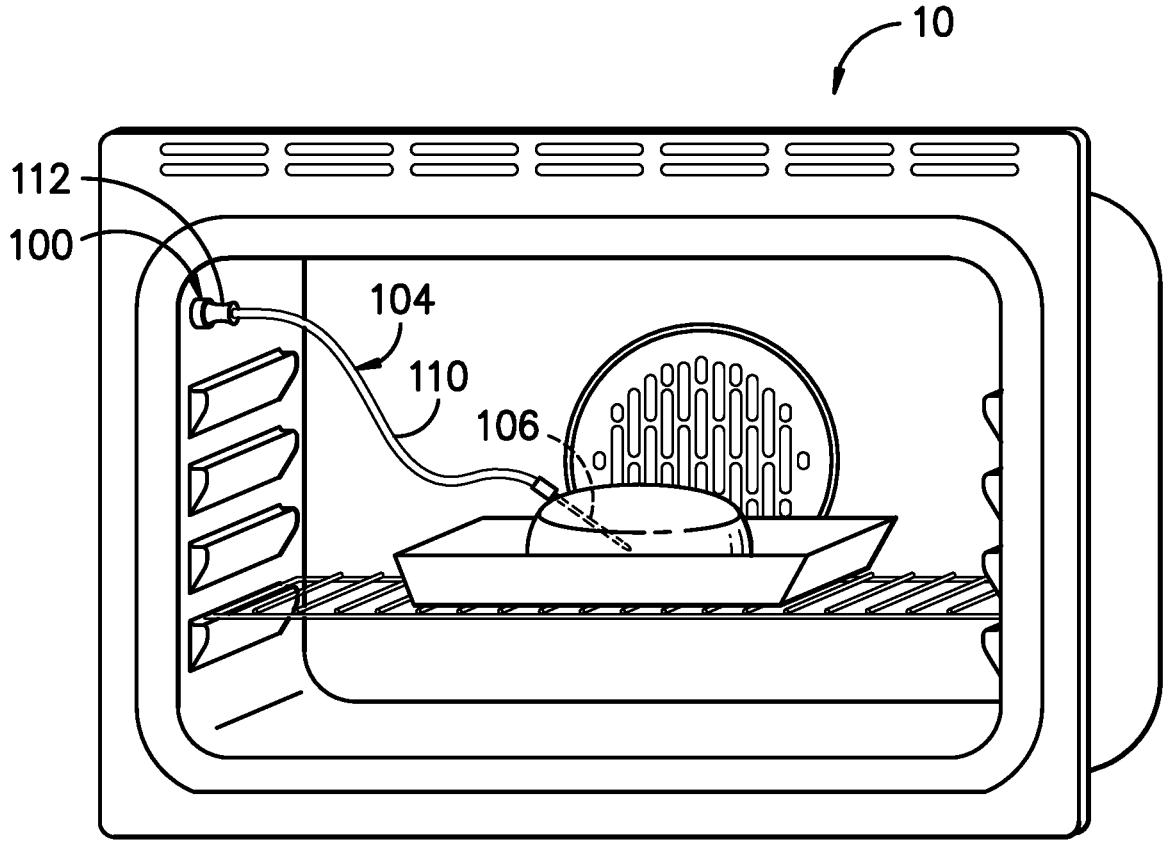
FIG. 4 illustrates a front, perspective view of one embodiment of an oven appliance having an adaptable port according to the present disclosure.
Figure 5:
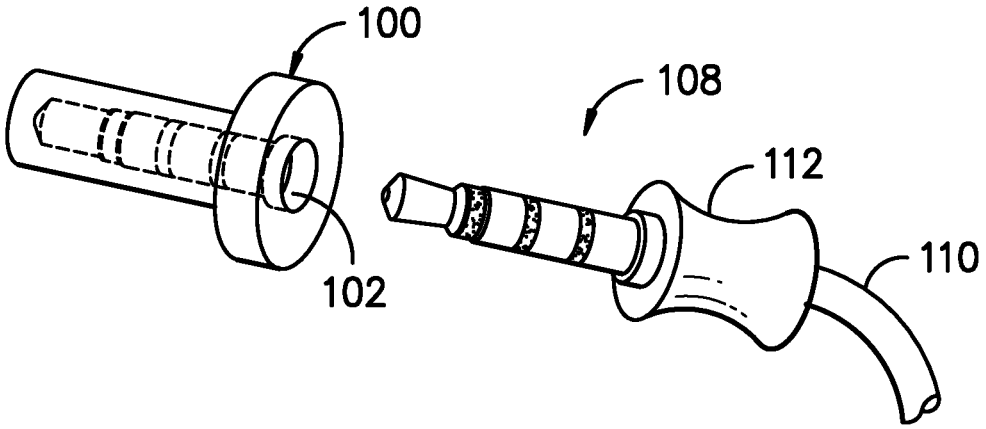
FIG. 5 illustrates an exploded, perspective view of one embodiment of a plug of an oven accessory being inserted into a port of the oven appliance 10.
Figures 6, 7:
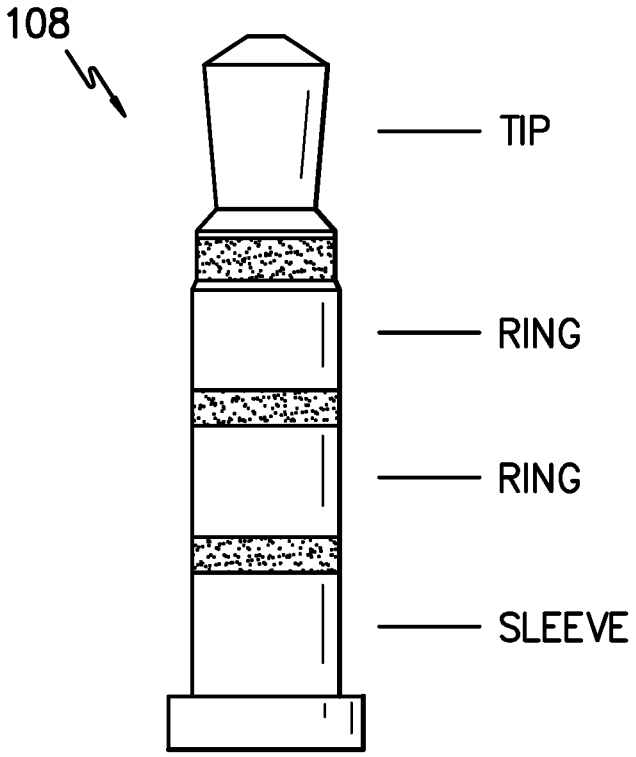
FIG. 6 illustrates a perspective view of one embodiment of a plug of an oven accessory according to the present disclosure.
FIG. 7 illustrates one embodiment of a look-up table relating oven accessory type to resistance value according to the present disclosure.

Referring now to FIGS. 4-6, various views of the oven appliance 10 of FIGS. 1 and 2 according to an exemplary embodiment of the present disclosure are illustrated. In particular, FIG. 4 provides a front, perspective view of the oven appliance 10, FIG. 5 provides an exploded, perspective view of one embodiment of a plug 108 of an oven accessory 100 being inserted into a port of the oven appliance 10, and FIG. 6 provides a perspective view of one embodiment of a plug 108 of the oven accessory 104 according to the present disclosure.

Referring particularly to FIG. 4, the oven appliance 10 also includes a port 100 having a socket 102. For example, in an embodiment, the socket 102 may have a tip-ring-ring-sleeve (TRRS) configuration, a tip-ring-sleeve (TRS), or any other suitable configuration. As used herein, and as particularly shown in FIG. 6, a TRRS socket and/or TRRS configuration generally encompasses a plug or connector having four conductors or poles (e.g. the tip, two rings, and the sleeve). Similarly, as used herein, TRS socket and/or TRS configuration generally encompasses a plug or connector having three conductors or poles (e.g. the tip, a ring, and the sleeve).

Accordingly, the oven appliance 10 can be compatible with a plurality of different types of oven accessories 104. In particular, as shown in FIGS. 4-6, each of the oven accessories 104 may include a probe 106 and a plug 108. In addition, as shown in FIG. 5, each oven accessory 104 may also include at least one resistive element 112 adjacent to the plug 108.

In the illustrated embodiment, as an example, the plug 108 may have a unique TRRS configuration for engagement with the socket 102 of the port 100. Thus, in such embodiments, the TRRS socket 102 of the oven appliance 10 can detect a sensor between the tip and the sleeve and can also read an identifying high temperature resistance value between the two rings. In addition, as an example, the resistive element(s) 112 described herein may include any suitable element, such as a resistor. In particular embodiments, for example, the resistive element(s) 112 may include one or more film resistors. As such, the resistive element(s) 112 described herein may be high temperature resistors (e.g. greater than 275 degrees Celsius (° C.), having a large resistance range (e.g. from about 20 ohms up to about 30 megohms), with very tight tolerances (e.g. as tight as 0.10%), and power ratings up to 22 Watts at 25° C. derates to zero at 275° C.

Accordingly, the controller 50 is communicatively coupled with the oven appliance 10 for determining a type of oven accessory 104 being used when a respective plug 108 is engaged with the port 100 based on a resistance value of the resistive element(s) 112 of the oven accessory 104. Such oven accessories may include, for example, a food probe (such as a meat probe), a pan/dish/stone probe, a coffee roaster probe, or similar. Since each oven accessory 104 has a unique resistor value that identifies what type of accessory it is, the controller 50 can select an appropriate cooking cycle to use with the particular type of oven accessory 104. In particular, the probe 106 of the oven accessory 104 may include at least one temperature sensor for measuring a temperature of a food item or associated pan during the cooking cycle. Similarly, such temperature sensors may include a food temperature sensor, a pan temperature sensor, a stone temperature sensor, a dish temperature sensor, a coffee roaster temperature sensor, or any other suitable temperature sensor now known or later developed in the art.

Furthermore, as depicted particularly in FIG. 4, the probe 106 of the oven accessory 104 is configured to be inserted into a food item (or pan, dish, stone, etc.) placed within the cooking chamber 14 and is configured to send signals to and receive signals from the controller 50. Thus, to send and receive signals, the probe 106 may include a transmission device and a receiving device (not shown) for communication with the controller 50. In some embodiments, the probe 106 may include a transceiver device that combines transmitting and receiving functionality. More specifically, as shown, the probe 106 may be communicatively coupled with the controller via a transmission cable 110, which also communicatively couples respective probes 106 with the respective plugs 108. In addition, the probe 106 may send signals indicative of the internal temperature of the food item in which the probe 106 is inserted to the controller 50 such that the signal may be interpreted by the controller 50. In this way, the oven appliance 10 may communicate the temperature of the food item to a consumer, e.g., by displaying the temperature on display component 55 (FIG. 1).

In another embodiment, the memory device(s) 54 described herein may have at least one of a table 114 or equation stored therein. For example, as shown in FIG. 7, the table 114 may be a look-up table that relates the type of oven accessory 104 (e.g. first column) with respective resistance values (e.g. second column). In certain embodiments, the table 114 and/or equation may be downloaded into the memory device(s) 54 of the controller 50 at any time. This feature allows for users to upgrade their oven appliance 10 over time as new oven accessories are developed.

Figure 8:
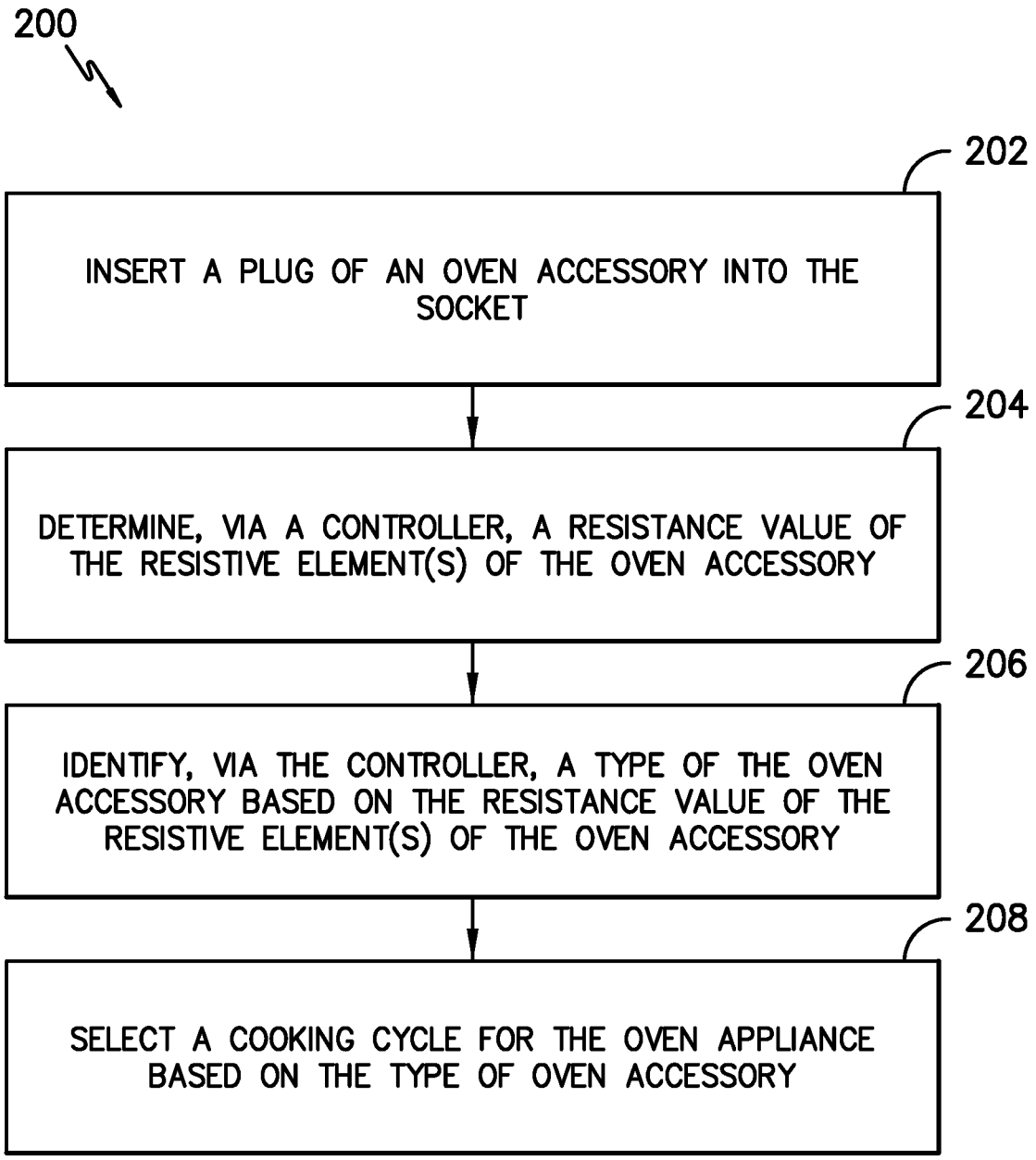
FIG. 8 illustrates a flow diagram of one embodiment of a method for operating an oven appliance having a port comprising a tip-ring-ring-sleeve (TRRS) socket according to the present disclosure.

Referring now to FIG. 8, a flow diagram of one embodiment of a method 200 for operating an oven appliance having a port defining socket according to the present disclosure is illustrated. In general, the method 200 will be described herein with reference to the oven appliance 10 and associated features shown in FIGS. 1-7. However, it should be appreciated that the disclosed method 200 may be implemented with oven appliances having any other suitable configurations. In addition, although FIG. 8 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown at (202), the method 200 includes inserting a plug 108 of an oven accessory 104 into the socket 102. As shown at (204), the method 200 includes determining, via a controller, a resistance value of the resistive element(s) 112 of the oven accessory 104. As shown at (206), the method 200 includes identifying, via the controller, a type of the oven accessory 104 based on the resistance value of the resistive element(s) 112 of the oven accessory 104. As shown at (208), the method 200 includes selecting a cooking cycle for the oven appliance 10 based on the type of oven accessory 104.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance assembly, comprising:

an oven appliance comprising:

a cabinet defining an oven cavity;

a heat source disposed within the oven cavity; and a port comprising a socket;

at least one oven accessory comprising a probe, a plug, and at least one resistive element adjacent to and contacting the plug, the plug comprising a unique configuration for engagement with the socket of the port, wherein the socket comprises a tip-ring-ring-sleeve (TRRS) configuration and the plug comprises a corresponding TRRS configuration; and a controller communicatively coupled with the oven appliance and the oven accessory, the controller comprising at least one processor for performing one or more operations, the one or more operations comprising:

determining a type of the at least one oven accessory engaged with the port of the oven appliance based on a resistance value of the at least one resistive element of the oven accessory.

2. The oven appliance assembly of claim 1, wherein the at least one resistive element comprises a film resistor.

3. The oven appliance assembly of claim 1, wherein the controller further comprises one or more memory devices having at least one of a table or equation stored therein, the table or equation relating a plurality of types of oven accessories with respective resistance values.

4. The oven appliance assembly of claim 3, wherein the controller is further configured to identify a cooking cycle to use with each of the plurality of types of oven accessories.

5. The oven appliance assembly of claim 4, wherein the probe further comprises at least one temperature sensor for measuring a temperature of an item during the cooking cycle within the oven cavity.

6. The oven appliance assembly of claim 5, wherein the at least one temperature sensor comprises at least one of a food temperature sensor, a pan temperature sensor, a stone temperature sensor, a dish temperature sensor, or a coffee roaster temperature sensor.

7. The oven appliance assembly of claim 1, wherein the oven accessory further comprises a transmission cable for communicatively coupling the probe with the controller, wherein the plug and the at least one resistive element are positioned at a proximal end of the transmission cable and the probe is positioned at a distal end of the transmission cable.

8. A method for operating an oven appliance having a port defining a socket, the method comprising:

inserting a plug of an oven accessory into the socket, the oven accessory having a probe, the plug, and at least one resistive element adjacent to and contacting the plug, the plug having a unique configuration, wherein the socket comprises a tip-ring-ring-sleeve (TRRS) configuration and the plug comprises a corresponding TRRS configuration;

determining, via a controller of the oven appliance, a resistance value of the at least one resistive element of the oven accessory;

identifying, via the controller, a type of the oven accessory based on the resistance value of the at least one resistive element of the oven accessory; and selecting a cooking cycle for the oven appliance based on the type of oven accessory.

9. The method of claim 8, wherein the at least one resistive element comprises a film resistor.

10. The method of claim 8, further comprising:

storing, via one or more memory devices of the controller, at least one of a table or equation relating different types of oven accessories with respective resistance values; and determining, via the controller, the resistance value of the oven accessory using at least one of the table or the equation.

11. The method of claim 8, wherein the probe of the oven accessory further comprises at least one temperature sensor for measuring a temperature of a food item during the cooking cycle.

12. The method of claim 11, wherein the at least one temperature sensor of each of the oven accessories comprises at least one of a food temperature sensor, a pan temperature sensor, a stone temperature sensor, a dish temperature sensor, or a coffee roaster temperature sensor.

13. The method of claim 8, wherein the oven accessory further comprises a transmission cable for communicatively coupling the probe with the plug, wherein the plug and the at least one resistive element are positioned at a proximal end of the transmission cable and the probe is positioned at a distal end of the transmission cable.

14. An oven appliance assembly, comprising:

an oven appliance, comprising:

a cabinet defining an oven cavity;

a heat source disposed within the oven cavity; and a port comprising a socket;

a plurality of oven accessories compatible with the oven appliance, each of the plurality of oven accessories comprising a probe, a plug, and at least one resistive element adjacent to and contacting the plug, each of the plugs comprising a unique configuration for engagement with the socket of the port, wherein the socket comprises a tip-ring-ring-sleeve (TRRS) configuration and the plug comprises a corresponding TRRS configuration; and a controller communicatively coupled with the oven appliance for determining a type of each of the plurality of oven accessories when a respective plug is engaged with the port based on a resistance value of each of the resistive elements of each of the plurality of oven accessories.

15. The oven appliance of assembly claim 14, wherein the controller further comprises one or more memory devices having at least one of a table or equation stored therein, the table or equation relating a plurality of types of oven accessories with respective resistance values.

16. The oven appliance of assembly claim 15, wherein the controller is further configured to identify a cooking cycle to use with each of the plurality of types of oven accessories.

17. The oven appliance assembly of claim 16, wherein the probes of the plurality of oven accessories each comprise at least one temperature sensor for measuring a temperature of an item during the cooking cycle within the oven cavity.

* * * * *